US010791776B2

(12) United States Patent
Arnold et al.

(10) Patent No.: US 10,791,776 B2
(45) Date of Patent: Oct. 6, 2020

(54) DUAL-LAYERED APPAREL SYSTEM

(71) Applicant: NIKE, Inc., Beaverton, OR (US)

(72) Inventors: Jacob R. Arnold, Portland, OR (US); Raj C. Mistry, Portland, OR (US)

(73) Assignee: NIKE, INC., Beaverton, OR (US)

( * ) Notice: Subject to any disclaimer, the term of this patent is extended or adjusted under 35 U.S.C. 154(b) by 127 days.

(21) Appl. No.: 15/967,108

(22) Filed: Apr. 30, 2018

(65) Prior Publication Data

US 2018/0343941 A1 Dec. 6, 2018

Related U.S. Application Data

(60) Provisional application No. 62/513,008, filed on May 31, 2017.

(51) Int. Cl.

| | |
|---|---|
| ***A41D 15/00*** | (2006.01) |
| ***A41D 15/04*** | (2006.01) |
| ***A41D 3/04*** | (2006.01) |
| ***A41D 27/20*** | (2006.01) |
| ***A41D 1/04*** | (2006.01) |
| ***A41D 13/05*** | (2006.01) |

(52) U.S. Cl.

CPC ..... *A41D 15/04* (2013.01); *A41D 1/04* (2013.01); *A41D 3/04* (2013.01); *A41D 13/0512* (2013.01); *A41D 13/0518* (2013.01); *A41D 13/0575* (2013.01); *A41D 15/00* (2013.01); *A41D 27/20* (2013.01); *A41D 2200/20* (2013.01); *A41D 2400/422* (2013.01); *A41D 2600/10* (2013.01)

(58) Field of Classification Search

CPC ..... A41D 15/00; A41D 15/04; A41D 3/04; A41D 27/20

See application file for complete search history.

(56) References Cited

U.S. PATENT DOCUMENTS

| | | | | |
|---|---|---|---|---|
| 5,077,838 | A * | 1/1992 | Senser | A41D 15/00 2/102 |
| 5,452,476 | A | 9/1995 | Jenks | |
| 7,117,539 | B1 | 10/2006 | Baacke | |
| 7,770,234 | B2 | 8/2010 | Roux et al. | |
| 9,060,553 | B2 | 6/2015 | Crye | |

(Continued)

FOREIGN PATENT DOCUMENTS

| | | |
|---|---|---|
| FR | 2819384 A1 | 7/2002 |

OTHER PUBLICATIONS

International Search Report and Written Opinion dated Sep. 3, 2018, in International Application No. PCT/US2018/034053, 12 pages.

(Continued)

*Primary Examiner* — Tajash D Patel

(74) *Attorney, Agent, or Firm* — Shook, Hardy & Bacon L.L.P.

(57) ABSTRACT

The present disclosure describes an apparel system for an upper torso of a wearer. The apparel system may comprise a first layer of a breathable fabric and a water resistant second layer. The second layer may be stowed in a pocket located on the front of the first layer. The second layer may be transitioned from within the pocket to cover at least a portion of the first layer to protect the wearer from external conditions. In some embodiments, the second layer may be affixed to the first layer at an area within the pocket.

15 Claims, 14 Drawing Sheets

(56) References Cited

U.S. PATENT DOCUMENTS

| | | | | |
|---|---|---|---|---|
| 2008/0271221 | A1 | 11/2008 | Zmigrosky | |
| 2011/0088135 | A1* | 4/2011 | Snyder | A41D 15/04 2/69.5 |
| 2016/0174633 | A1* | 6/2016 | Macrae | A45F 4/12 2/69.5 |
| 2019/0307179 | A1* | 10/2019 | Beard | A41D 31/102 |

OTHER PUBLICATIONS

International Preliminary Report on Patentability dated Dec. 12, 2019 in International Patent Application No. PCT/US2018/034053, 8 pages.

* cited by examiner

DUAL-LAYERED APPAREL SYSTEM

CROSS-REFERENCE TO RELATED APPLICATIONS

This application, having U.S. application Ser. No. 15/967,108, entitled "DUAL-LAYERED APPAREL SYSTEM," and filed on Apr. 30, 2018, claims the benefit of priority of U.S. Provisional Application No. 62/513,008, entitled "DUAL-LAYERED APPAREL SYSTEM," and filed on May 31, 2017, which is incorporated by reference in its entirety.

TECHNICAL FIELD

Aspects herein relate to an apparel system with a stowed second layer that may be deployed over first layer to protect a wearer from external conditions.

BACKGROUND

During exercise, it may be preferable to wear a garment on the upper torso that comprises a breathable material, such as a knitted fabric. However, during outdoor exercise, a person may experience precipitation, causing these materials to absorb external moisture and leading to poor functionality of the material and/or garment.

BRIEF DESCRIPTION OF DRAWINGS

The Detailed Description describes embodiment of the present disclosure with reference to the attached drawing figures, wherein.

DETAILED DESCRIPTION

Figure 1A:
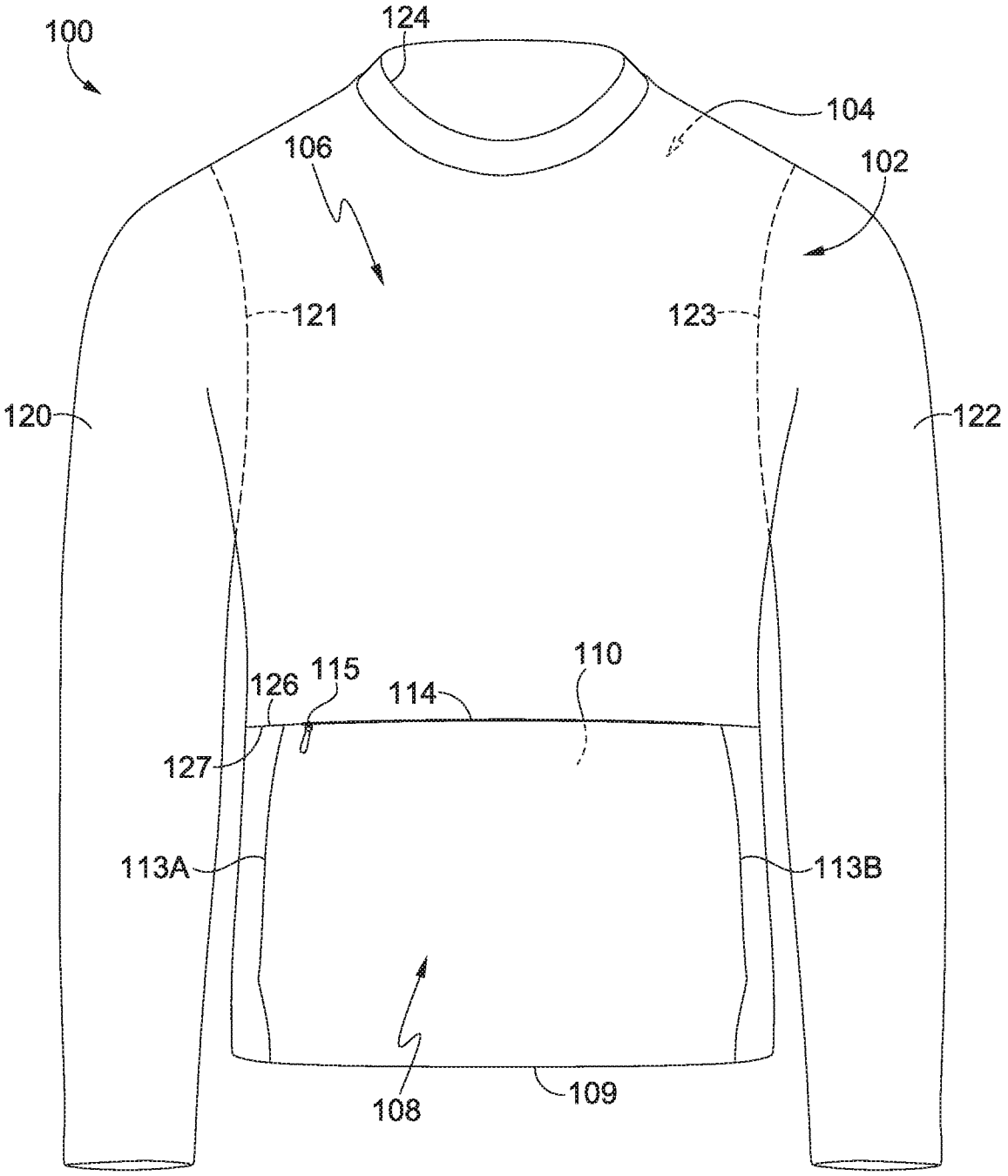
FIGS. 1A and 1B illustrate a front side view of a first layer of an exemplary apparel system, and a back side view of the first layer of the apparel system, respectively, in accordance with an aspect described herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Positional terms as used herein such as "front," "back," "side," "upper," "lower," and the like are with respect to the apparel system being worn by a hypothetical wearer standing in anatomical position. Terms such as "secured," "affixed," "coupled," and the like may mean releasably affixing two or more elements together using affixing technologies such as buttons, snaps, zippers, hook-and-loop fasteners, and the like. However, these terms may also mean permanently affixing two or more elements together using affixing technologies such as stitching, bonding, adhesives, welding, and the like. A distinction between releasably affixing and permanently affixing will be provided where appropriate. Further, when used herein, phrases such as "configured to cover [a body portion] of a wearer," are to be construed with respect to the apparel system being appropriately sized for the given wearer.

In brief, and at a high level, the present disclosure relates to an apparel system having a first layer formed from a breathable material. The first layer may comprise a pocket that may stow a second layer formed from a water resistant material. The second layer may be transitioned from the stowed position to a deployed position by a wearer when, for example, exercising in inclement weather. In the deployed position, the second layer covers at least a portion of the first layer, providing the wearer protection against inclement weather conditions, such as precipitation.

To provide easy access to the second layer, the pocket may be located on the lower front of the first layer. The location of the pocket is easily accessible by the wearer, even during exercise. As such, the wearer may be able to transition the second layer from the pocket and don the second layer over the first, all without having to cease the exercise activity. Thus, when donned by the wearer, the second layer provides additional protection against inclement weather.

This type of apparel system is particularly useful for wearers that are caught in unplanned precipitation. For example, a wearer that is engaged in exercising, such as running, may wish to run with the second layer in the stowed position, i.e., the second layer is positioned within the pocket. In this position, the apparel system provides additional breathability by allowing moisture vapor to escape to the external environment. However, if precipitation begins to occur, the wearer may quickly and easily don the second layer over the first, i.e., the deployed position, thereby increasing the protection against precipitation. Moreover, as will be explained further below, due to the shape configuration of the second layer, the breathability of the first layer is generally maintained even when the second layer is in the donned state.

The easy transition from the stowed position to the deployed position is facilitated, in part, by the single connection of the second layer to the first layer at a point and/or seam line corresponding to the top margin of the pocket. This single connection point, however, provides for other useful aspects as well. Because the second layer is secured to the first layer, it cannot easily be misplaced or dropped while transiting from one position to another. Further, in exemplary aspects, the connection point between the two layers may be positioned within the pocket. This helps the wearer transition the second layer from the deployed position back to the stowed position because part of the second layer is already inside of the pocket, serving as a reference point to easily transition the remaining portion of the second layer within the pocket. Thus, both donning and doffing the second layer may be performed with minimal attention required by the wearer, freeing up the wearer to maintain concentration on the particular activity that he or she is engaged in.

Additional aspects that help facilitate donning and doffing the second layer include the shape configuration of the second layer. The second layer may have a minimalist shape that is configured to provide protection in areas where it is most needed, such as the top of the head, the shoulder area, and the upper torso. The second layer may have a curved back portion that helps provide for easy transition while exercising, yet still provides protection where it is needed. By having a minimalist construction that provides protection only where it is needed most, the overall weight of the second layer may be reduced. This lightweight second layer not only provides for easy donning and doffing, but is also beneficial for the wearer because it is less cumbersome.

One aspect the apparel system for an upper torso of a wearer comprises a first layer having a front side opposite a back side. The front side may have a pocket that has a top margin, and the top margin of the pocket comprises an opening to the pocket. The apparel system further comprises a second layer positioned over the first layer. The second layer covers at least a shoulder portion of the first layer. The second layer may comprise a front side opposite a back side. The second layer front side may be defined by at least a first bottom edge, where the first bottom edge is affixed to the first layer at a location corresponding to the top margin of the pocket.

In another aspect, an apparel system for an upper torso of a wearer comprises a first layer having a front side opposite a back side, where the front side has a pocket with a pocket space and a pocket opening that is in communication with the pocket space. The apparel system also comprises a second layer that covers at least a portion of the first layer. The second layer may have a front side opposite a back side. The second layer may be affixed to the first layer at a location inside the pocket.

In yet another aspect, an apparel system for an upper torso comprises a first layer having a front side opposite a backside, where the front side comprises a first pocket having a first pocket opening. The apparel system also comprises a second layer having a front side opposite a back side, where the second layer covers at least a shoulder portion of the first layer. The second layer may be affixed to the first layer at a single location corresponding to a top margin of the first pocket.

Throughout this description, the term "deployed position" will be used when discussing the orientation of the disclosed apparel system. The deployed position denotes the position when the second layer is deployed over the first layer of the apparel system. In aspects, this term may be used interchangeably with the term "as-worn position." The term "as-worn positions" means the deployed apparel system as donned by a wearer. For example, in the as-worn position, a shirt is oriented such that a neck opening will be at the top of the shirt and near the upper end of the wearer's torso. Similarly, in the as-worn position, the shirt would be oriented such that a waist opening is at the bottom of the shirt and near the waist of the wearer.

Figure 1B:
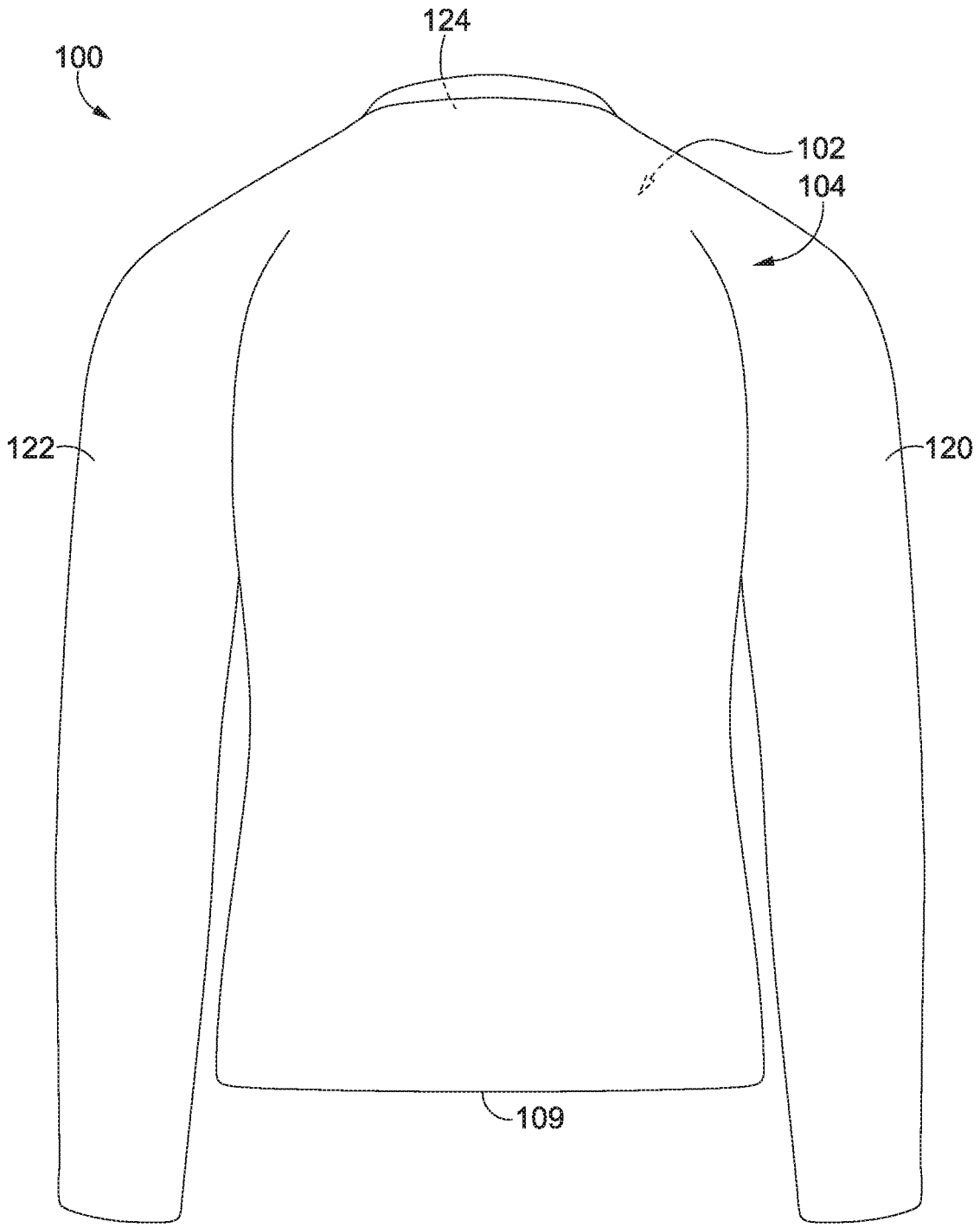

Turning now to FIGS. 1A and 1B, an aspect of an exemplary apparel system is presented. FIG. 1A depicts a view of a front side 102 of a first layer 100, while FIG. 1B depicts a view of a back side 104 of the first layer 100. Together, the front side 102 and the back side 104 of the first layer 100 define at least a neckline opening 124, a waist opening 109, a first sleeve opening 121, and a second sleeve opening 123. In exemplary aspects, a first sleeve 120 may extend from the first sleeve opening 121, and a second sleeve 122 may extend from the second sleeve opening 123. Although the first layer 100 is shown as a long sleeve garment, it is contemplated herein that the first layer 100 may comprise a three-quarter sleeve garment, a half-sleeve garment, a sleeveless garment, and the like. Further, it is contemplated herein that the front side 102 and the back side 104 may comprise separate panels of material jointed together at one or more seams. It is also contemplated herein, that the front side 102 and the back side 104 may comprise a single panel of material formed through, for instance, a circular knitting process, a flat knitting process, a weaving process, and the like. Any and all aspects, and any variation thereof, are contemplated as being within aspects herein.

In exemplary aspects, at least a portion of the first layer 100 may be formed from a knit material that provides breathability (i.e., the ability for moisture vapor to move through the material) and/or air permeability. The material may also be selected to have moisture management characteristics (i.e., the ability for a material to move moisture from one face of the material to the opposite face of the material (e.g., an outer-facing surface of the material) through, for instance, capillary action or other types of mechanisms). It is contemplated herein, that the first layer 100 may be a skin-contacting layer. In such instances, the first layer 100 may be formed from a knit material having a soft hand. It is also contemplated herein that one or more portions of the first layer 100 may optionally be formed from a woven material. For example, a tightly woven material may be used in one or more portions to provide wind protection. The woven material also may be used in areas subject to higher-than-normal wear-and-tear as woven materials tend to be more durable than knit materials. Any and all aspects, and any variation thereof, are contemplated as being within aspects herein.

In exemplary aspects, the front side 102 may comprise an upper section 106 and a lower section 108. In some instances, the upper section 106 may be permanently affixed to the lower section 108, such as by stitching together a bottom margin 126 of the upper section 106 and a top margin 127 of the lower section 108. In some aspects, however, there may be no delineation point between the upper section 106 and the lower section 108. Instead, the upper section 106 and the lower section 108 may simply describe a region of the front side 102 of the apparel system. For example, the upper section 106 and the lower section 108 may be made of the same fabric, which may extend without interruption from generally the neckline opening 124 to the waist opening 109 of the first layer 100.

The lower section 108 of the front side 102 may additionally comprise a first pocket 110 having a first pocket opening 114. The first pocket 110 is shown by a dashed line to indicate that it is hidden from view, as will be explained below. In exemplary aspects, the first pocket 110 may extend the entire length of the lower section 108, or it may extend through only a portion of the length of the lower section 108.

To describe it a different way, the first pocket 110 may extend from the top margin 127 of the lower section 108 to the waist opening 109, or it may extend throughout only a portion of the space between the top margin 127 of the lower section 108 and the waist opening 109. In some embodiments, the first pocket opening 114 may be located on or near the top margin 127 of the lower section 108, and in some cases, the first pocket opening 114 may help to delineate, in whole or in part, the upper section 106 from the lower section 108. In some aspects, the top margin 127 of the lower section 108 and the bottom margin 126 of the upper section 106 may be unaffixed along at least a portion of their length to form the first pocket opening 114.

In exemplary aspects, the first pocket opening 114 may be sealable. For instance, the first pocket opening 114 may comprise a slider mechanism 115 (such as the exemplary zipper shown in FIG. 5B) to facilitate opening and closing the first pocket opening 114. Other mechanisms for sealing the first pocket opening 114 are contemplated; some examples include buttons, snaps, hook-and-loop-type fasteners, other slider mechanisms, and the like. The first pocket opening 114 may extend the entire width, as measured horizontally, of the lower section 108 or only a portion thereof. Any and all aspects, and any variation thereof, are contemplated as being within aspects herein.

Figure 3:
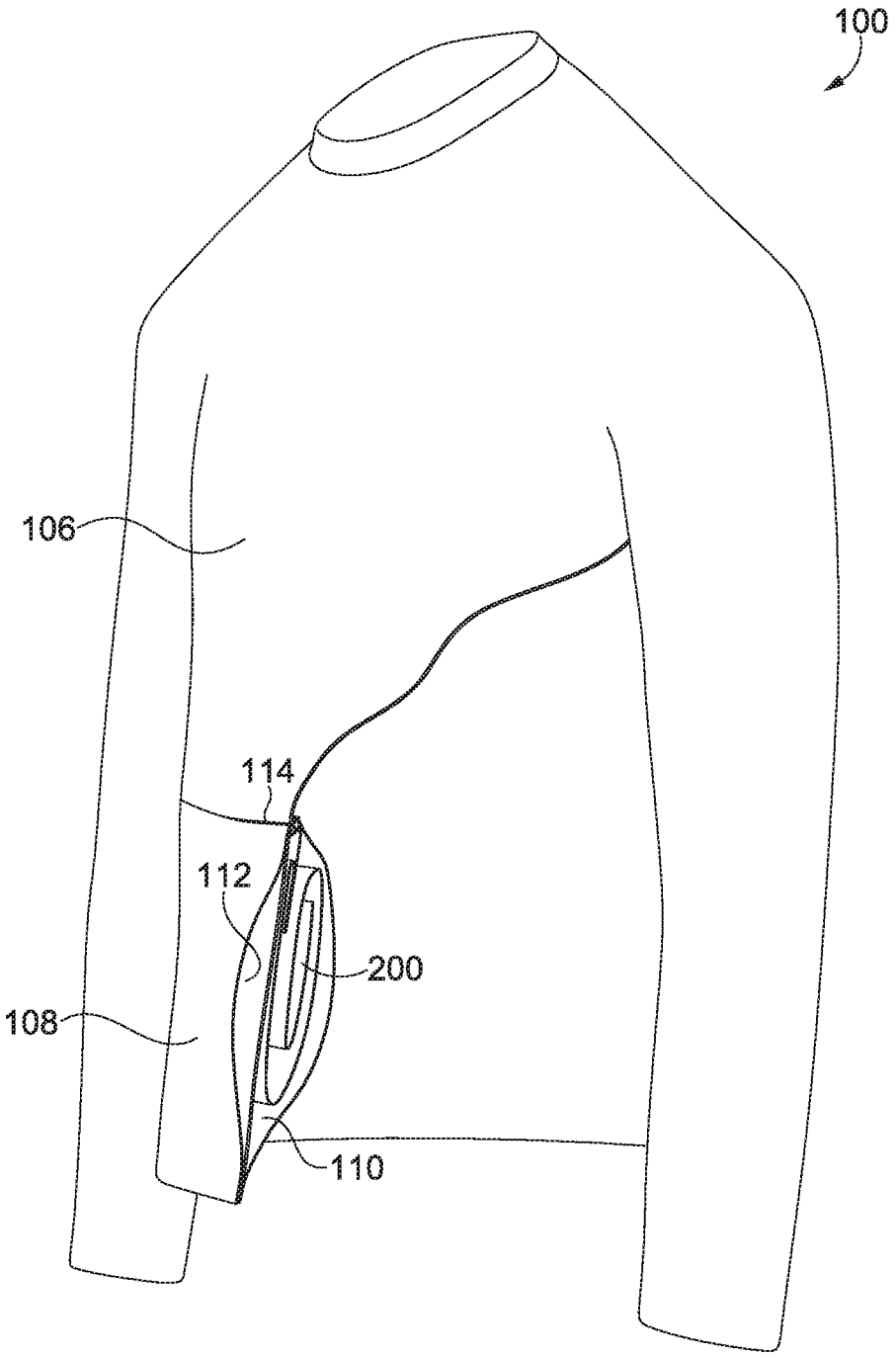
FIG. 3 illustrates the front side view of the first layer having a cut away portion to view the second layer in a stowed position, in accordance with an aspect described herein.

As shown more clearly in FIG. 3, in some aspects, the lower section 108 of the front side 102 may comprise an optional second pocket 112 that is positioned adjacent and external to the first pocket 110. With respect to FIG. 3, the second pocket 112 may be formed by layering a material over the outer-facing surface of the first pocket 110 to form a pocket space between the two layers. The second pocket 112 may extend across the entirety of the lower section 108 (i.e., extend over the length and width of the lower section 108), or it may extend only over a portion of the lower section 108 (i.e., extend over a portion of the length and/or a portion of the width of the lower section 108). In some aspects, the second pocket 112 may comprise a "kangaroo" type pocket with openings 113A and 113B positioned on each lateral side of the second pocket 112. An example of the second pocket openings 113A and 113B is illustrated in FIG. 1A. In some aspects the second pocket 112 may be made of a woven fabric and/or made of a treated material that renders at least a portion of the second pocket 112 water resistant and/or wind resistant. Materials may be treated, for example, with a durable water repellant (DWR). Such treatments are generally known in the art, and their use is contemplated within this disclosure. The woven fabric may be the same type of woven fabric as used in the second layer 200 (described below) or may be an alternative woven fabric. In some aspects, all or portions of the second pocket 112 may comprise a treated material.

FIG. 1B illustrates one aspect of the back side 104 of the first layer 100. In exemplary aspects, the back side 104 of the first layer 100 may comprise a single expanse of material extending from the neckline opening 124 to the waist opening 109. In other words, unlike the front side 102 of the first layer 100 which may be demarcated into the upper section 106 and the lower section 108 comprising at least the first pocket 110, the back side 104 may comprise a single or unitary section without demarcation although other configurations are contemplated as being within the scope herein.

Figure 2A:
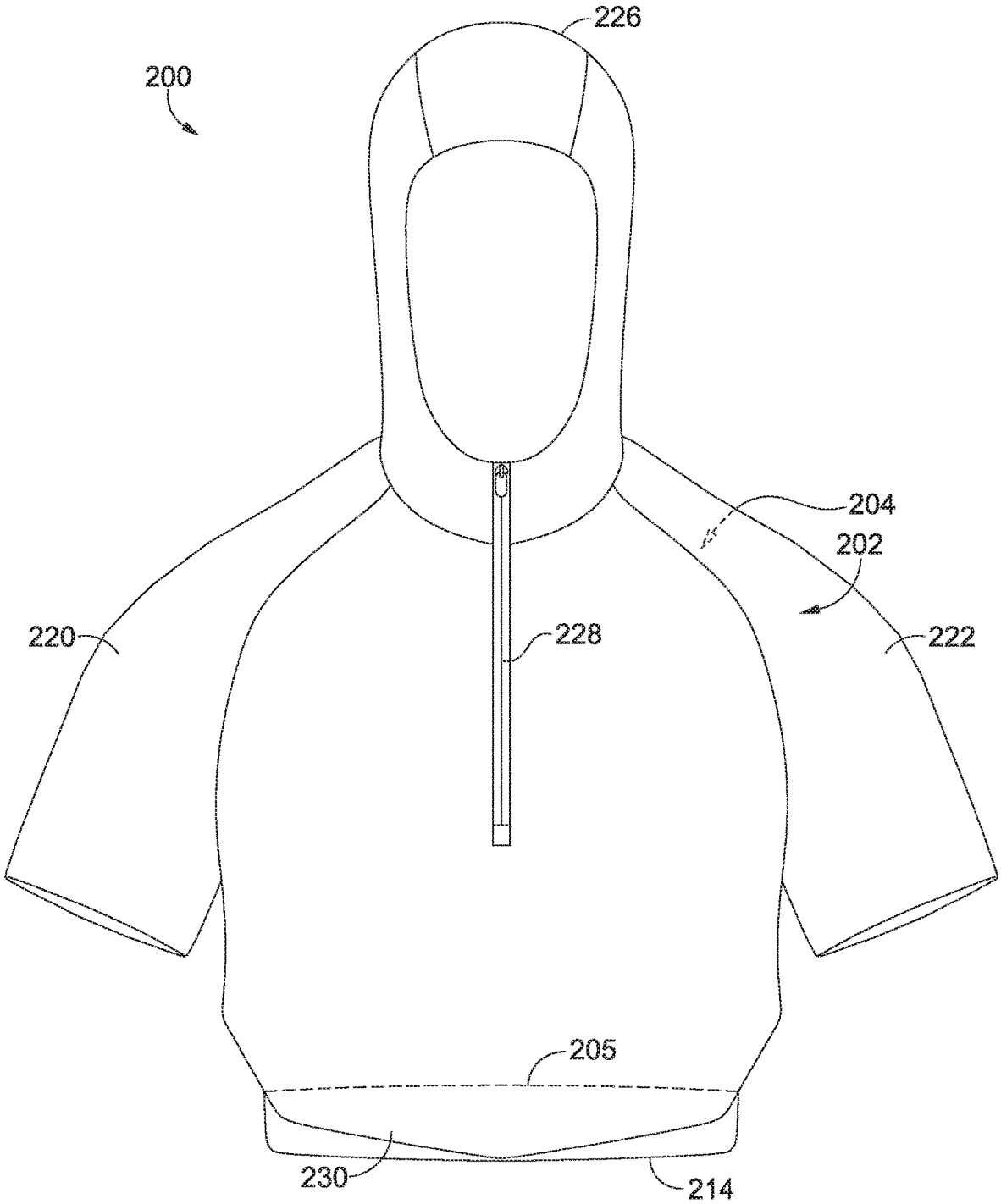
FIGS. 2A and 2B illustrate a front side view of a second layer of the exemplary apparel system, and a back side view of the second layer of the exemplary apparel system, respectively, in accordance with an aspect described herein.
Figure 2B:
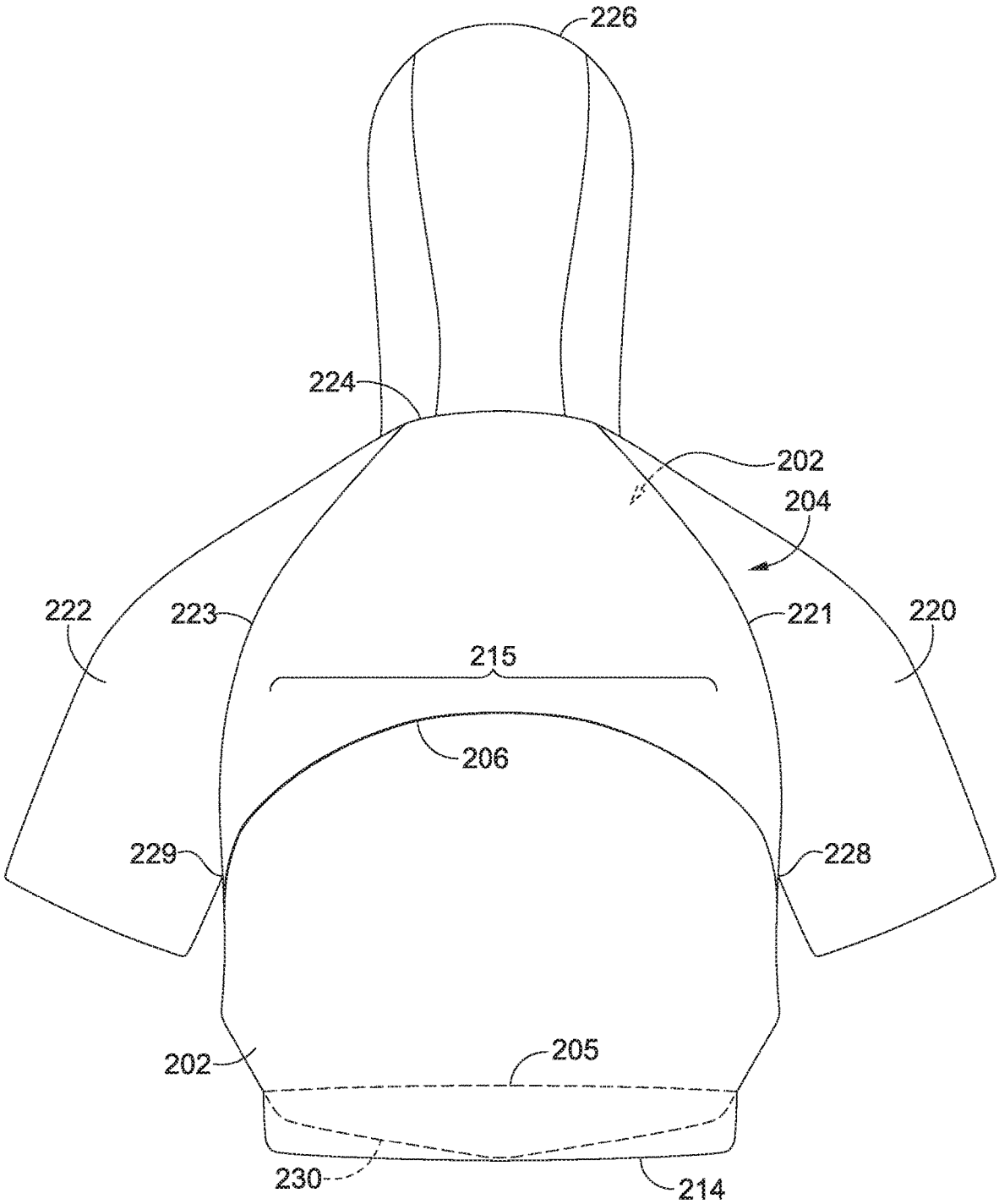

Turning now to FIGS. 2A and 2B, an exemplary aspect of the second layer 200 of the apparel system is illustrated in accordance with aspects herein. FIG. 2A depicts a front side 202 of the second layer 200, while FIG. 2B depicts a back side 204 of the second layer 200. In some aspects, at least a portion of the second layer 200 may comprise a water resistant or waterproof material. For instance, the second layer 200 may be formed from a woven material treated with a DWR finish. In other aspects, the entirety of the second layer 200 may comprise a water resistant or waterproof material. It is further contemplated herein that the second layer 200 may be formed from a lightweight material to decrease the overall weight of the apparel system.

The front side 202 together with the back side 204 may define a neckline opening 224 (shown in FIG. 2B), a first sleeve opening 221, and a second sleeve opening 223 for the second layer 200. In some aspects, the second layer 200 may comprise a hood 226 that may be affixed to or extend from the neckline opening 224. Similarly, a first sleeve 222 and a second sleeve 220 may be affixed to or extend from the first sleeve opening 221 and the second sleeve opening 223, respectively. As shown, the first and second sleeves 222 and 220 may comprise short sleeves. However, it is contemplated herein that the first and second sleeves 222 and 220 may comprise three-quarter sleeves, full sleeves, or even no sleeves. With respect to the aspect shown in FIGS. 2A and 2B, the sleeves 120 and 122 of the first layer 100 may be greater in length than the sleeves 220 and 222 of the second layer 200.

With respect to FIG. 2A, the front side 202 may comprise a first bottom edge 214 where the front side 202 inferiorly terminates. In some aspects, the first bottom edge 214 may inferiorly terminate at or between 20 cm to 40 cm from the neckline opening 224.

In some aspects the front side 202 of the second layer 202 may comprise a flap attachment margin 205. The flap attachment margin 205 is represented by a dashed line in the figures (for example, FIGS. 2A and 4A). However, it should be understood that in some configurations, there may be no physical demarcation of the flap attachment margin 205. The flap attachment margin 205 is described herein simply to reference an exemplary area to which a flap 230 may be affixed and/or extend, such as shown in FIG. 5B. In some aspects, the flap 230 may extend inferiorly from the flap attachment margin 205. In some aspects, the flap 230 may comprise an integral extension from the flap attachment margin 205 of the front side 202 (i.e., created through a single knitting or weaving event). Or the flap 230 may comprise a separate panel affixed to the flap attachment margin 205 of the front side 202 via one or more seams. Any and all aspects, and any variation thereof, are contemplated as being within aspects herein.

In some aspects, the second layer 200 may further comprise a slider mechanism 228, such as a zipper, that extends downward from the neckline opening 224 on the front side 202. The slider mechanism 228 may further help to secure the second layer 200 to the wearer once the second layer 200 is donned.

FIG. 2B illustrates an exemplary aspect of the back side 204 of the second layer 200. In some aspects, the first sleeve opening 221 may extend from the neckline opening 224 to an inferior most margin 228 of the first sleeve opening 221. Similarly, the second sleeve opening 223 may extend from the neckline opening 224 to an inferior most margin 229 of the second sleeve opening 223. In some aspects, the back side 205 may comprise a lower back margin 206 where the back side 204 of the second layer 200 inferiorly terminates. In some cases, the lower back margin 206 may comprise a curve 215. As better illustrated in FIG. 4B, the curve 215 may have a curve midpoint 210 (as measured with respect to a hypothetical vertical midline 207) that extends superiorly towards the neckline opening 224. To describe it another way, the curve 215 of the lower back margin 206 may extend symmetrically downward from the curve midpoint 210 and away from the hypothetical vertical midline 207. Further, in the deployed position of some aspects, the lower back margin 206 may terminate at a location above a hypothetical horizontal midline 209 that extends through the back side 104 of the first layer 100 midway between the neckline opening 124 and the waistline opening 109 of the first layer 100. To describe this in different fashion, the curve midpoint 210 may be at a distance 211 from the neckline midpoint 208, where the distance 211 may be at or between 15 to 25 cm. Referring back to FIG. 2B, in some aspects, a lowermost portion of the curve 215 of the lower back margin 206 may be horizontally aligned with the inferior margins of the sleeve openings 228 and 229 in some exemplary aspects.

The shape configuration of the back side 204 of the second layer 200, including the curve 215 and the alignment of the curve 215 relative to the inferior margins of the sleeve openings 228 and 229, helps facilitate easier donning of the second layer 200 by, for instance, making the sleeve openings 221 and 223 easily accessible. In addition, the shape configuration of the second layer 200 may maximize protection against precipitation while still maintaining a minimalist construction. For example, the second layer 200 is configured to cover just the areas of the first layer 100 that are most susceptible to precipitation as determined from, for example, rain mapping data. The overall shape configuration of the second layer 200 may be selected based on, for instance, maps of where rain or precipitation is likely to contact a wearer when standing or, for example, running in a forward direction. Thus, as shown, the second layer 200 is configured to provide coverage of the wearer's head, upper back torso, upper arms, and upper front torso, as these areas represent areas of high precipitation exposure. By minimizing the size and dimensions of the second layer 200, a lightweight apparel system may be achieved. Moreover, by minimizing the size of the second layer 200, easier donning and doffing may also be achieved.

As previously mentioned, the second layer 200 may be stowed in the first pocket 110 when not being used. This position is described as the stowed position and is best represented by FIG. 3. FIG. 3 provides an exemplary view of the apparel system having a cut-away portion. The first pocket 110 may be positioned within the lower section 108 of the first layer 100. The optional second pocket 112 is shown positioned adjacent and external to the first pocket 110. In this exemplary aspect, the upper section 106 is affixed to the lower section 108, and the first pocket opening 114 is provided along a portion of the area in which the upper section 106 and the lower section 108 are affixed.

Figure 4A:
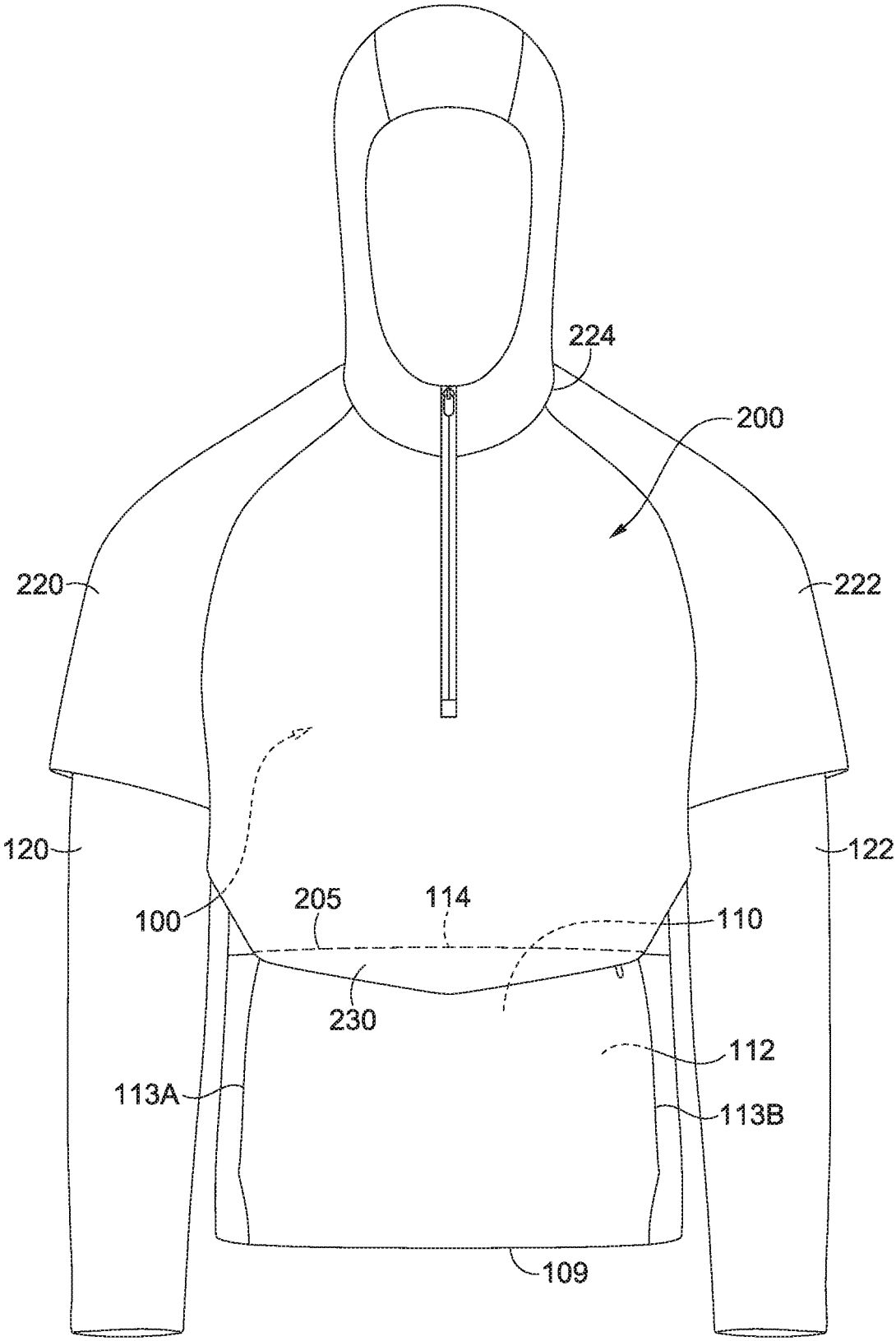
FIGS. 4A and 4B illustrate a front side view of the exemplary apparel system and a back side view of the exemplary apparel system, respectively, in the deployed position in accordance with an aspect described herein.

Turning now to FIG. 4A, this figure illustrates the apparel system comprising the second layer 200 positioned over the first layer 100 in accordance with aspects herein. As can be seen in FIG. 4A, in the deployed position of some aspects of the apparel system, the first bottom edge 205 of the second layer 200 may be posited at a location corresponding to the first pocket opening 114 (e.g., the top margin of the first pocket 110). In this position, the flap 230 may extend inferiorly from the front side 202 of the second layer 200 so that it is positioned adjacent and external to the first pocket opening 114. The flap 230 may be positioned to cover the first pocket opening 114 when the apparel system is in the deployed position to help prevent rain or precipitation from entering the apparel system via the first pocket opening 114.

Figure 4B:
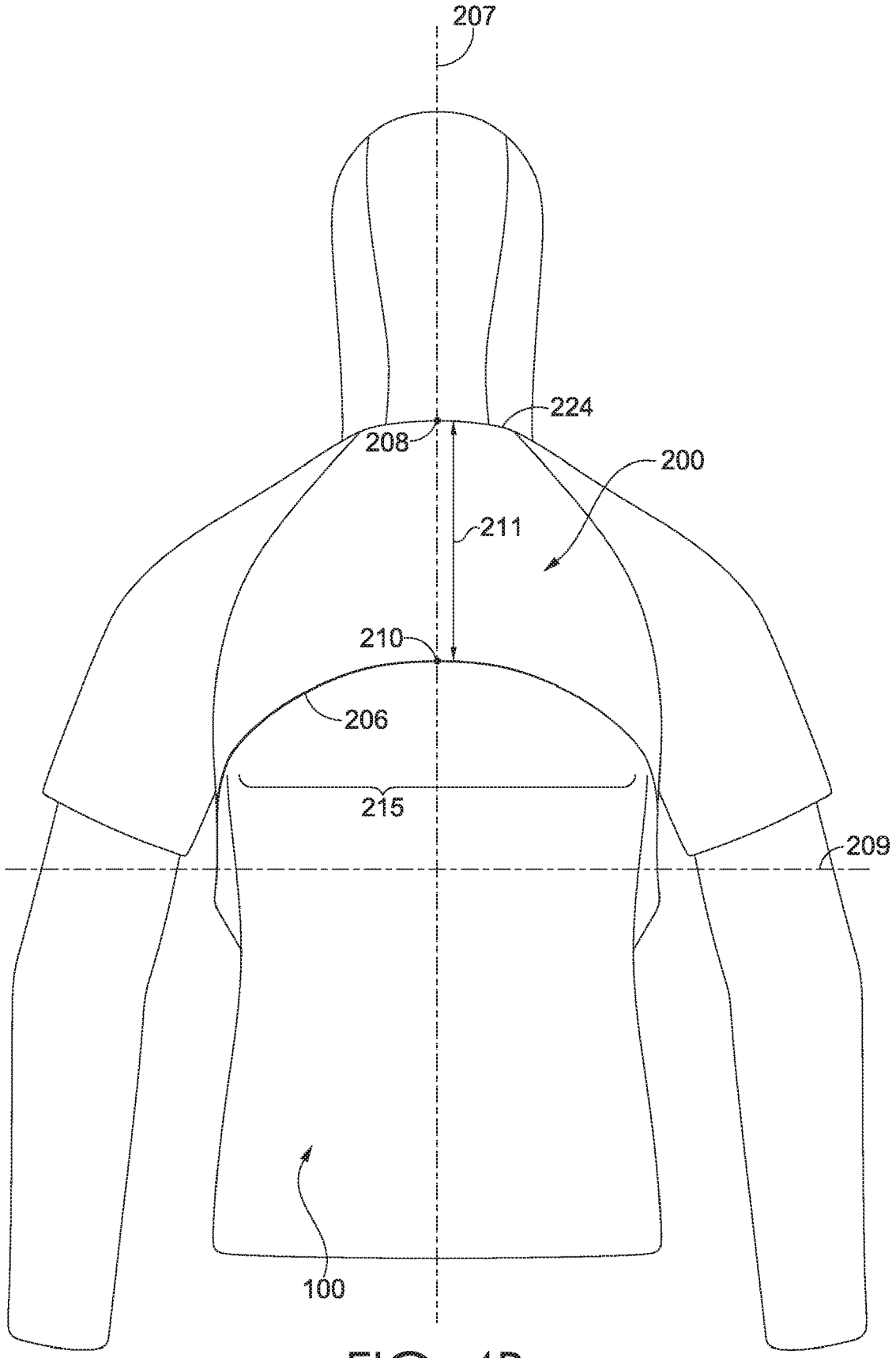

When in the deployed position, the second layer 200 may be positioned to cover at least a portion of the first layer 100. FIGS. 4A and 4B respectively illustrate the position of the front and back of the second layer 200 relative to the first layer 100 in the deployed position. In general, the front side 202 of the second layer 200 is configured to cover at least a portion of the front side 102 of the first layer 100, while the back side 204 of the second layer 200 is configured to cover at least a portion of the back side 104 of the first layer 100. And, as explained above, the shape configuration of the second layer 200 may be optimized to provide protection to areas of the wearer's body likely to be exposed to precipitation (based on, for example, rain maps) while still maintaining a low profile for easier donning and doffing.

Figure 5A:
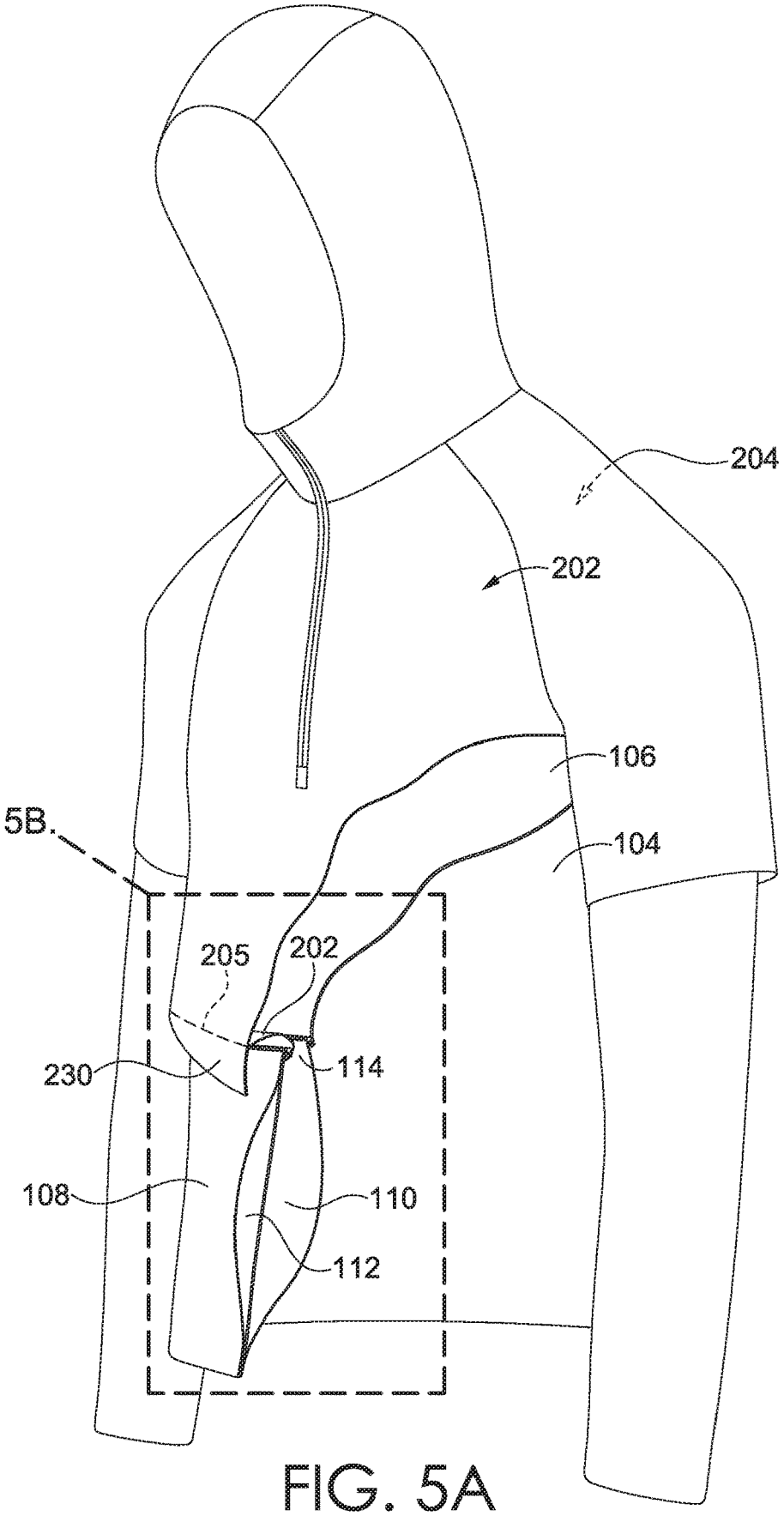
FIG. 5A illustrates a perspective view of the front side of the exemplary apparel system in the deployed position with a cut away portion in accordance with an aspect described herein.
Figure 5B:
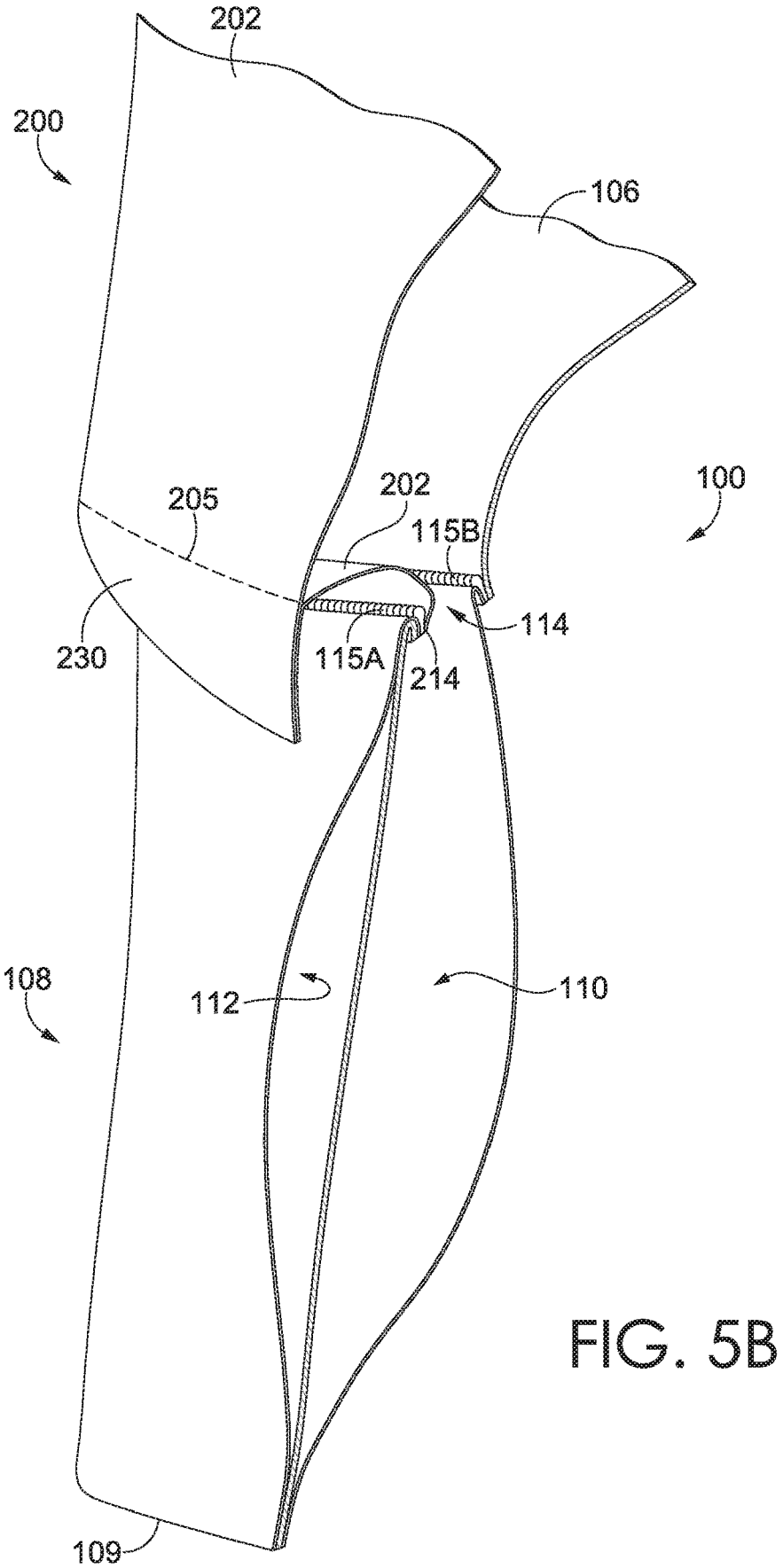
FIG. 5B illustrates an isolated view of the cut away portion of FIG. 5A in accordance with an aspect herein.
Figure 5C:
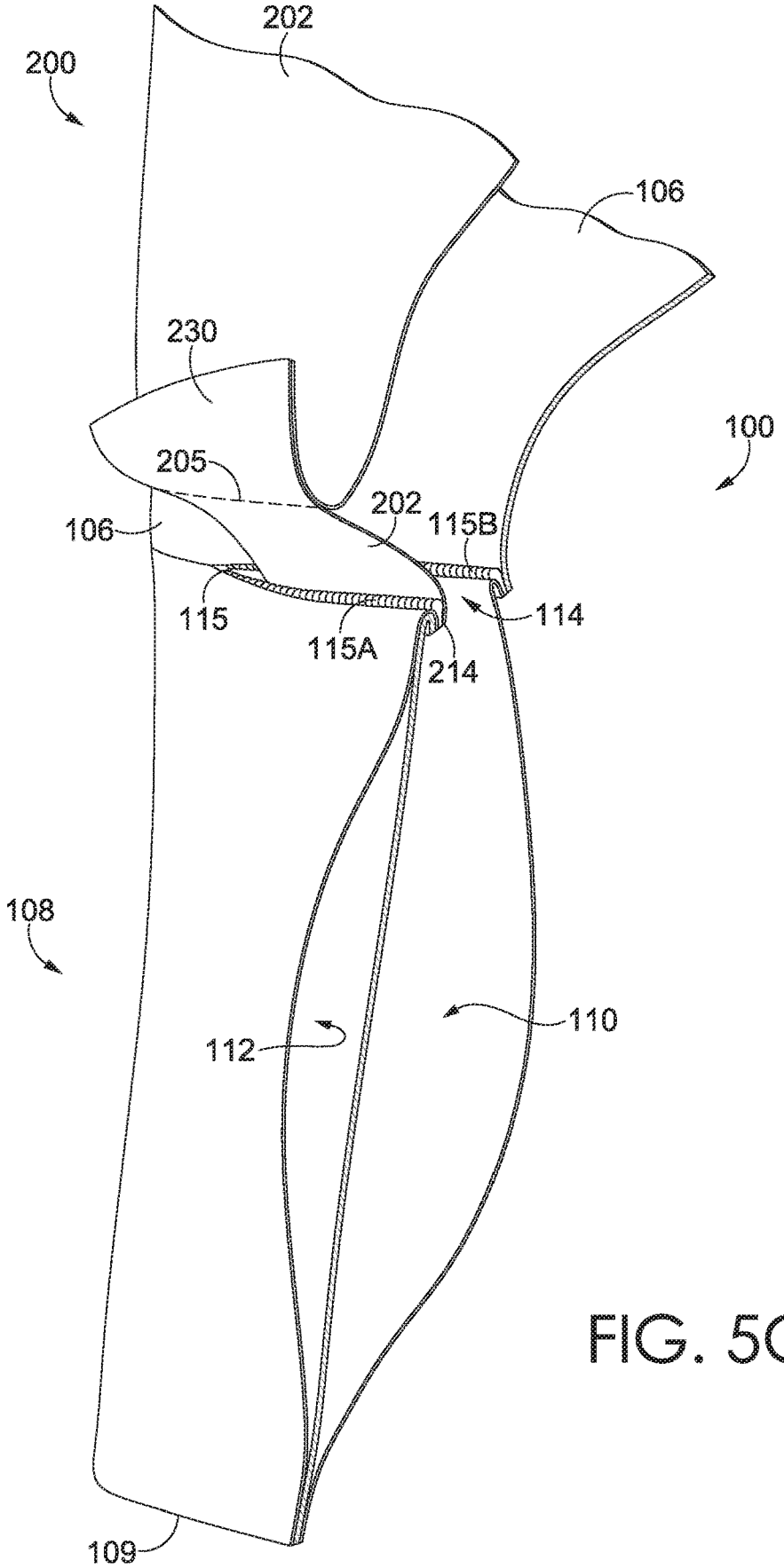
FIG. 5C illustrates another isolated view of the cut away portion of FIG. 5A in accordance with aspects herein.

FIGS. 5A-5C show examples of how the second layer 200 may be affixed to the first layer 100 so that the second layer 200 may be transitioned from a stowed position to a deployed position during exercise. FIG. 5A shows the second layer 200 in a deployed position. A section of the first layer 100 and the second layer 200 is cut away to reveal how the different layers 100 and 200 may be coupled to each other. With a section of the apparel system cut away, FIG. 5A shows how the front side 202 of the second layer 200 covers at least a portion of the front side 106 of the first layer 100. The front side 202 of the second layer 200 may be affixed to the lower section 108 of the first layer 100 along an inside margin of the first pocket 110 at an area corresponding to the first pocket opening 114. The flap 230 may extend inferiorly from a location illustrated as the flap attachment margin 205 of the second layer 200. The optional second pocket 112 is shown adjacent and external to the first pocket 110 on the lower section 108 of the first layer 100.

FIG. 5B illustrates an isolated view of the cut-away section of FIG. 5A. As can be seen in FIG. 5B, in exemplary aspects the second layer 200 may be permanently attached to the first layer 100 at the first bottom edge 214 of the second layer 200 using affixing technologies such as stitching, bonding and the like to help ensure that the second layer 200 does not become misplaced. However, it is also contemplated herein that the second layer may be removably attached to the first layer 100 at the first bottom edge 214 of the second layer 200 using affixing technologies such as button, snaps, hook-and-loop fasteners, and the like. In some aspects, the first bottom edge 214 of the second layer 200 may be affixed to the first layer 200 at a location corresponding to the first pocket opening 114. An example of this is shown in FIG. 5B, which illustrates the first bottom edge 214 of the front side 202 of the second layer 200 affixed just below the first pocket opening 114 and horizontally aligned with a front slider portion 115A of slider mechanism 115. More generally speaking, in some aspects, the front slider portion 115A is at a location that corresponds with a front edge of the first pocket opening 114. The front slider portion 115A and the back slider portion 115B are portions of slider mechanism 115. In some aspects, the point of attachment at the first pocket opening 114 may be the only point of affixation between the second layer 200 and the first layer 100.

FIG. 5C shows another view of the embodiment depicted in FIG. 5B. In this view, the flap 230 has been lifted upward to more clearly show the upper section 106 and the lower section 108 of the front side 102 of the first layer 100 with respect to the first pocket opening 114.

These aspects, in part, provide particular benefits. By attaching the first bottom edge 214 of the second layer 200 horizontally along the front slider portion 115A of the slider mechanism 115, the first pocket opening 114 is not open to the external environment when the second layer 200 is deployed. To describe it a different way, when deployed, the second layer 200 "covers" the first pocket opening 114 due to its attachment adjacent and inferior to the front slider portion 115A (as opposed to, for instance, the back slider portion 115B). For example, precipitation that may fall on the front side 202 of the second layer 200 may bead up and run down the front side 202. But in aspects where the first bottom edge 214 is affixed within the first pocket 210 adjacent the front slider portion 115A of the slider mechanism 115, the precipitation beads are not be able to access the inside of the first pocket 110 due to the second layer 200 covering the first pocket opening 114 when deployed. Instead, they fall away from the second layer 200 toward the ground. Additionally, in aspects, the flap 230 of the second layer 200 provides additional protection against precipitation entering the first pocket 110 or falling onto the lower section 108 of the first layer 100.

A further benefit provided by these aspects is that the first pocket opening 114 remains accessible to a wearer when the second layer 200 is in the deployed configuration. Looking at FIG. 5B and FIG. 5C, when the second layer 200 is in the deployed position, the first pocket opening 114 is disposed between the second layer 200 and the first layer 100. In some instances, the wearer may reach between the second layer 200 and the first layer 100 and access the first pocket opening 114. As such, if caught in unsuspected precipitation, the wearer may have access to the first pocket 110 to quickly and easily stash items that he or she may not want to get wet, such as a cellphone.

Figure 6A:
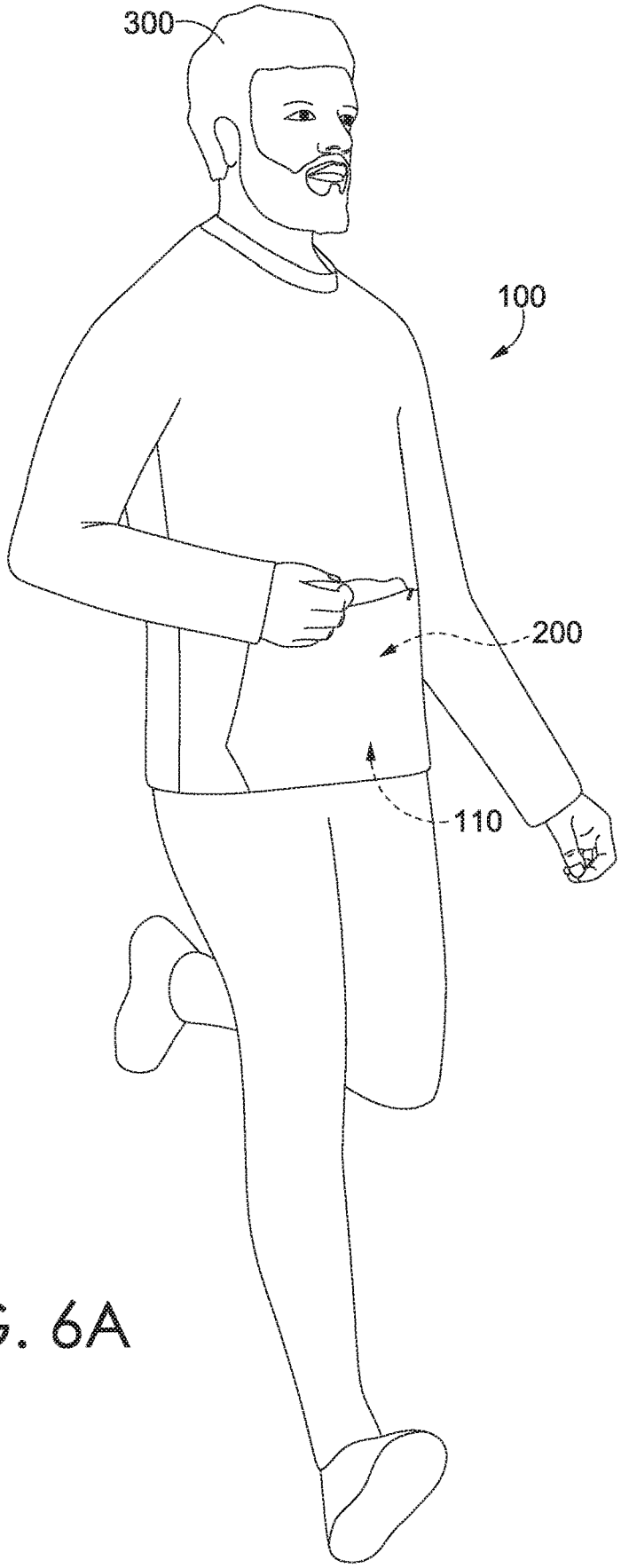
FIGS. 6A-6D illustrate exemplary stages of a wearer transitioning the second layer from a stowed position, as shown in FIG. 6A, to an deployed position, as shown in FIG. 6D, in accordance with aspects herein.
Figure 6B:
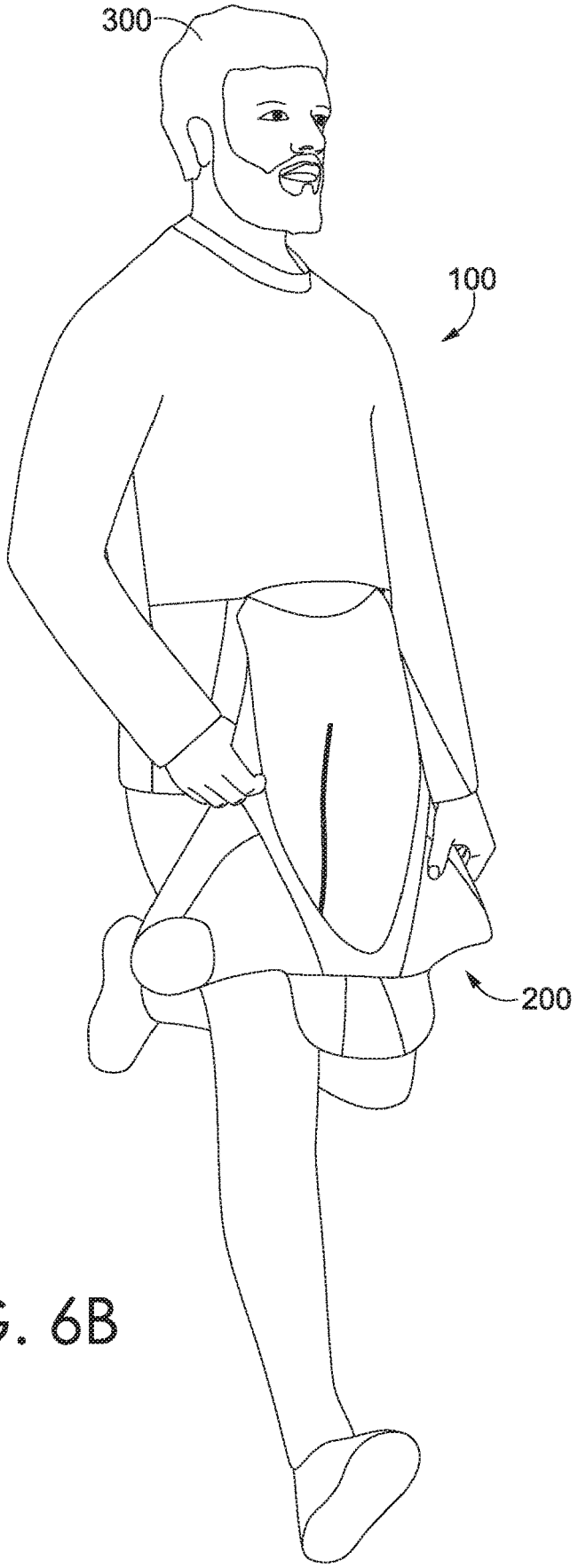
Figure 6C:
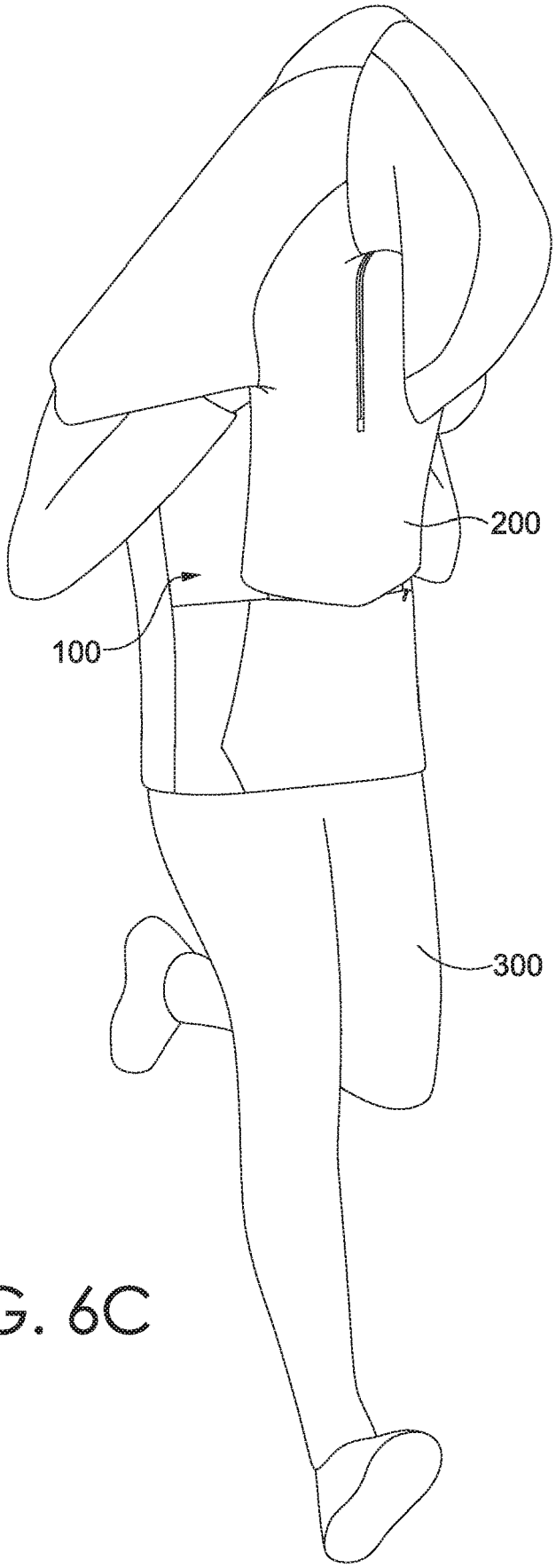
Figure 6D:
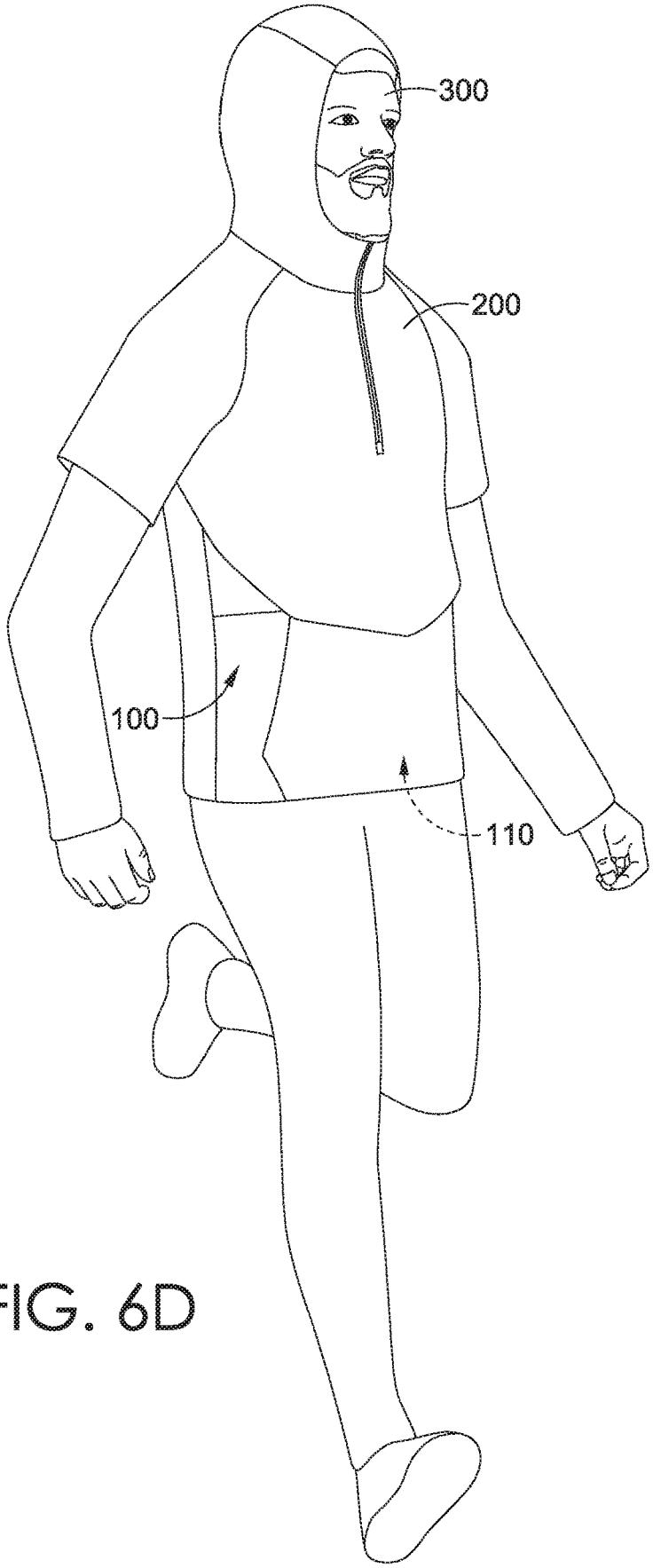

FIGS. 6A-6D illustrate various exemplary stages of a wearer 300 transitioning the second layer 200 of the apparel system from the stowed position in FIG. 6A to the deployed position in FIG. 6D. The apparel system provides for easily transitioning the second layer 200 from the stowed position to the deployed position without the wearer 300 having to cease activity.

In FIGS. 6A-6D the wearer 300 is illustrated as running. In FIG. 6A, the second layer 200 of the apparel system is in the stowed position (e.g., stowed within the first pocket 110), but the wearer 300 has begun to remove the second layer 200 from the first pocket 110 to transition to the deployed position in FIG. 6D. This is easily done by the wearer 300, in part, because of the location of the first pocket 110 at the lower, front area of the torso nearest the wearer's 300 hands.

In FIG. 6B, the wearer 300 has removed the second layer 200 from the stowed position. Because the first bottom edge 214 of the second layer 200 is secured to the first layer 100 on the inside of the first pocket 110 (as shown in FIGS. 5A-5C), the second layer 200 is automatically in the correct position to be donned by the wearer 300 once removed from the first pocket 110. Put another way, when the wearer 300 pulls the second layer 200 out of the first pocket 110, the wearer 300 does not have to concentrate on adjusting the second layer 200 into a particular position. Instead, the second layer 200 is already in the proper anatomical orientation to be donned. As such, the wearer 300 may easily don the second layer 200 by moving it above the wearer's 300 head and over the shoulders. Because of the shape configuration of the back side 204 of the second layer 200, the second layer 200 easily moves over the wearer's head and shoulders, and the wearer may easily slip into each sleeve of the second layer 200 at the same time. As a result, the second layer 200 settles into the correct deployed position, shown in FIG. 6D, with minimal effort or concentration by the wearer 300. Thus, throughout transitioning the second layer 200 from the stowed position to the deployed position, the wearer 300 may continue to concentrate on the activity.

From the foregoing, it will be seen that the embodiments described herein are well adapted to attain all the ends and objects described, including other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope, it is to be understood that all matters described and depicted in the accompanying drawings are to be interpreted as illustrative and not in a limiting sense.

What is claimed:

1. An apparel system for an upper torso of a wearer comprising:

a first layer having a front side opposite a back side, the front side of the first layer comprising an upper section and a lower section, the lower section adjacent to and extending downward from the upper section, the front side having a pocket having at least a top margin, wherein the top margin of the pocket comprises an opening to the pocket, the opening to the pocket having a front edge, and wherein the pocket is located on the lower section; and a second layer positioned over the first layer such that it covers at least a shoulder portion of the first layer, the second layer comprising a front side opposite a back side, the second layer front side defined by at least a first bottom edge, wherein the first bottom edge is affixed to the first layer at a location corresponding to the front edge of the opening to the pocket.

2. The apparel system of claim 1, wherein the top margin of the pocket is horizontally aligned with an upper margin of the lower section.

3. The apparel system of claim 1, wherein the first bottom edge of the second layer is affixed to the first layer inside of the pocket at the location corresponding to the front edge of the opening to the pocket.

4. The apparel system of claim 3, wherein an only point of affixation between the first layer and the second layer is inside of the pocket at the location corresponding to the front edge of the opening to the pocket.

5. The apparel system of claim 1, wherein the second layer further comprises a flap that extends downward from the second layer so that the flap is positioned adjacent and external to the opening to the pocket.

6. The apparel system of claim 1, wherein the back side of the second layer comprises a lower back margin having a curve that extends downward and away from a midpoint of the curve.

7. The apparel system of claim 6, wherein the back side of the second layer comprises at least a portion of a neckline opening, the neckline opening having a midpoint, wherein a distance between the midpoint of the neckline opening and the midpoint of the curve is at or between 15 cm to 25 cm.

8. The apparel system of claim 1, wherein the front side and the back side of the second layer form a neckline opening, and wherein a hood extends from the neckline opening.

9. The apparel system of claim 1, wherein at least a portion of the first layer is formed from a knitted material.

10. The apparel system of claim 1, wherein at least a portion of the second layer is formed from a woven material treated with a durable water repellant.

11. An apparel system for an upper torso of a wearer, the apparel system comprising:

a first layer having a front side opposite a back side, the front side of the first layer comprising a lower section extending downward from an upper section, wherein the front side comprises a pocket having a pocket space and a pocket opening in communication with the pocket space, and wherein the pocket is located on at least a portion of the lower section; and a second layer that covers at least a portion of the first layer, the second layer having a front side opposite a back side, wherein the second layer is affixed to the first layer at a location inside the pocket, and wherein the location inside the pocket where the second layer is affixed to the first layer corresponds to a front edge of the pocket opening.

12. The apparel system of claim 11, wherein the first layer comprises a first set of sleeves, and wherein the second layer comprises a second set of sleeves.

13. The apparel system of claim 12, wherein the first set of sleeves of the first layer are longer than the second set of sleeves of the second layer.

14. The apparel system of claim 12, wherein the back side of the second layer comprises a lower back margin, and wherein at least a portion of the lower back margin of the back side of the second layer is generally horizontally aligned with an inferior margin of the second set of sleeves at a location corresponding to where the second set of sleeves extend from sleeve openings of the second layer.

15. An apparel system for an upper torso of a wearer, the apparel system comprising:

a first layer having a front side opposite a back side, the front side of the first layer comprising a lower section extending downward from an upper section, the front side comprising a pocket having a pocket opening, the pocket opening having a front edge, wherein the pocket is located on the lower section; and a second layer having a front side opposite a back side, the second layer covering at least a shoulder portion of the first layer, wherein the second layer is affixed to the first layer at a single location corresponding to the front edge of the pocket opening.

* * * * *